US006051045A

United States Patent [19]

Narula et al.

[11] Patent Number: 6,051,045

[45] **Date of Patent: *Apr. 18, 2000**

[54] METAL-MATRIX COMPOSITES

[75] Inventors: Chaitanya Kumar Narula; Sabine R. Nakouzi-Phillips, both of Ann Arbor; Gary Mark Crosbie, Dearborn, all of Mich.

[73] Assignee: Ford Global Technologies, Inc., Dearborn, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/585,676

[22] Filed: Jan. 16, 1996

[51] Int. Cl.[7] ..... B22F 3/16; C22C 1/05

[52] U.S. Cl. ..... 75/233; 75/230; 75/235; 419/13; 419/19; 419/23; 419/38

[58] Field of Search ..... 428/544, 545; 75/230, 233, 235; 419/13, 19, 23, 38

[56] References Cited

U.S. PATENT DOCUMENTS

| | | | |
|---|---|---|---|
| 4,731,132 | 3/1988 | Alexander | 148/437 |
| 4,818,633 | 4/1989 | Dinwoodie et al. | 428/614 |
| 5,006,417 | 4/1991 | Jackson et al. | 428/614 |
| 5,145,513 | 9/1992 | Matteazzi et al. | 75/255 |
| 5,256,368 | 10/1993 | Oden et al. | 419/10 |
| 5,482,778 | 1/1996 | Aghajanian et al. | 428/472 |
| 5,543,367 | 8/1996 | Narula et al. | 501/87 |
| 5,677,029 | 10/1997 | Prevorsek et al. | 501/87 |

FOREIGN PATENT DOCUMENTS

| | | |
|---|---|---|
| 0 333 629 | 9/1989 | European Pat. Off. . |
| 0 529 520 | 3/1993 | European Pat. Off. . |

*Primary Examiner*—Donna Wortman
*Assistant Examiner*—Brenda G. Brumback
*Attorney, Agent, or Firm*—Lorraine S. Melotik

[57] ABSTRACT

This invention is directed to metal-matrix composites which include a substantially continuous phase of metal and reinforcing ceramic particulate substantially uniformly dispersed therein and comprising at least two of barium titanium, titanium dioxide, and titanium nitride. The composite may include other reinforcing ceramic particulate materials like metal carbides such as titanium carbide and other titanates like calcium titanate. The reinforcing particulate can comprise up to about 70 volume percent of the composite and have an average particle diameter of between about 0.1 micron and 100 microns. In forming the composite, the metal powder employed has an average particle diameter between about 1 and 20 microns. The composite is useful to manufacture, e.g., automotive parts such as brake rotors and structural components.

20 Claims, 2 Drawing Sheets

METAL-MATRIX COMPOSITES

FIELD OF THE INVENTION

The invention is directed to the fabrication of metal-matrix composites formed by reinforcing metals, e.g., light-weight metals like aluminum with ceramic particles such as barium titanate and titanium nitride.

BACKGROUND OF THE INVENTION

The need to replace iron based metals to reduce the weight of automotive vehicles has led to the use of light weight metals such as aluminum and magnesium alloys. Pure aluminum can not be used due to its low melting point and strength, but by including a desirable amount of silicon with the aluminum, a suitable alloy can be prepared. Aluminum-silicon eutectics are quite common in the fabrication of engine components such as blocks and cylinder heads.

Since the 1960's, it has been known that the mechanical properties of light alloys can be greatly enhanced by reinforcing them with ceramics in the form, e.g., of fibers, whiskers, or particulate. These materials, called metal-matrix composites [MMC], are a promising family of next generation structural materials and will be playing a role in replacing metals in the fabrication of automotive components. In addition to reduced weight, the MMC based components show improved NVH, controlled thermal expansion, and improved thermal and mechanical durability.

The common methods for the fabrication of MMCs include melt stirring and pressureless liquid metal infiltration, pressure infiltration, and powder metallurgy. The selection of the optimal method to prepare MMCs depends on a number of factors including economics and the nature of the raw materials. Components of complex shape may be fabricated by casting, forging, or extrusion. For example, fabrication using the powder metallurgy method involves mixing powdered metals with reinforcing ceramics and also binders to form the green bodies which are then subjected to elevated temperatures to remove the organic binder. Each green body is then fired to obtain the component in finished form. The selection of a reinforcing material is based on economic factors, chemical stability, and desired properties.

For the automotive industry, the MMCs of present interest are based on aluminum with reinforcing particles of SiC, TiC or $Al_2O_3$ as primary reinforcement materials in volume fractions ranging from 5 to 30 percent. The automotive industry has shown a considerable interest towards using these MMCs for fabricating a wide variety of parts including drive shafts, cylinder liners, rocker arms, connecting rods, and suspension components.

One of the drawbacks of making the MMCs is the high cost associated with the ceramic reinforcement materials. It would be desirable to provide other reinforcement materials for MMCs which are more cost effective and also provide excellent physical properties to the composites. It is important that the reinforcing particulates have good comparability with the metal, that is, that the reinforcing particulate have physical properties such as density, modulus, and coefficient of thermal expansion which are compatible with the metal to provide a strong and durable MMC. The invention disclosed herein provides MMCs with excellent physical properties and advantageously uses relatively low cost ceramic materials as the reinforcing materials.

DISCLOSURE OF THE INVENTION

The invention is directed to a metal-matrix composite made by powder metallurgy Techniques and comprising: (a) a substantially continuous phase metal and (b) reinforcing ceramic particulate substantially uniformly dispersed therein, the particulate comprising at least two of: barium titanate, titanium dioxide, and titanium nitride, wherein the ceramic particulate has an average particle diameter of between 0.1 microns and 100 microns and comprises up to about 70 volume percent of the composite. The particulate may comprise other materials like metal carbides such as titanium carbide and other metal titanates such as calcium titanate.

The invention, in another embodiment, comprises the method for making the metal-matrix composite disclosed above by powder metallurgy and involves mixing powdered metal having an average particle size between about 1 and 20 microns, and the particles disclosed above, subjecting the powder mixture to a pressure necessary to form a green body thereof, and firing the green body at an elevated temperature and for a time necessary to form the composite.

DESCRIPTION OF THE PREFERRED EMBODIMENTS

Figure 1:
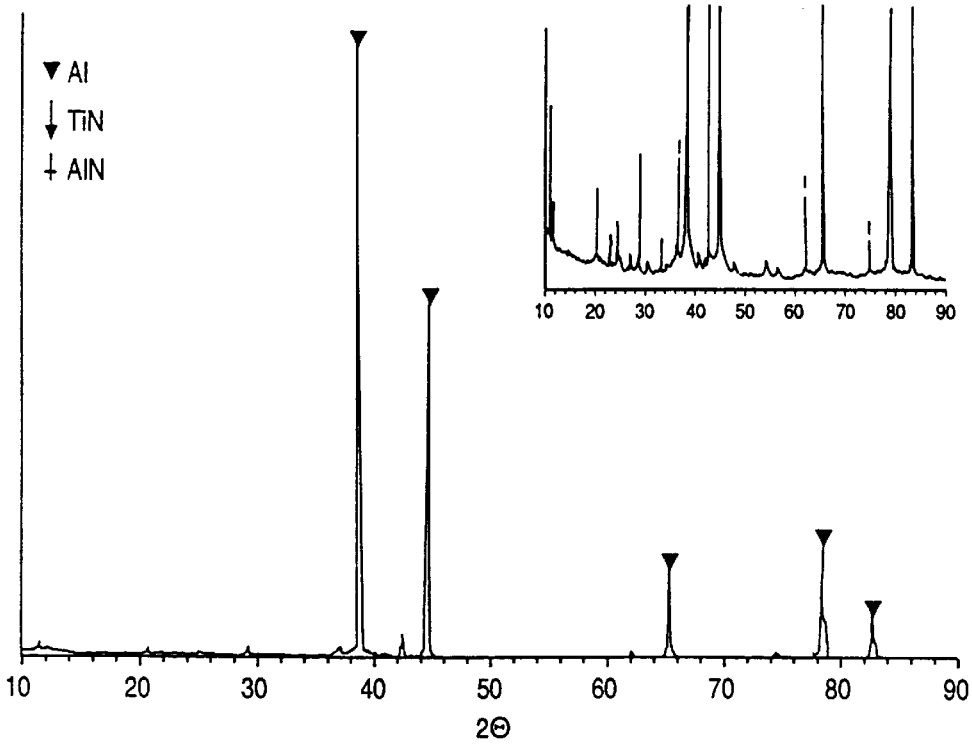
FIG. 1 is an X-Ray Powder Diffraction of a metal matrix composite according to an embodiment of the present invention including a 50:50 mixture of $TiO_2$:TiN in aluminum.

The present invention is a metal matrix composite particularly useful to make a variety of automotive components. Good candidates include brake rotors, calipers, cylinder liners and suspension components. This invention is not, however, limited to using the MMC materials to form automotive components. The MMCs of the present invention are also suitable for a variety of non-automotive applications including structural items and electronic packaging.

The present invention composites comprise a substantially continuous phase of metal with a mixture of reinforcing ceramic particulate substantially uniformly dispersed therein. These metals include such lightweight metals like aluminum, titanium and magnesium and other metals like copper and nickel. These lightweight metals, i.e., metals lighter than iron, are particularly useful in automotive applications. Still other metals useful in this invention will be apparent to those skilled in the art in view of the present invention. In forming the metal-matrix composite according to powder metallurgy techniques, the metal in powder form is mixed with the reinforcing ceramic particulate. This powder mixture is then formed into a green body by subjecting the mixture to suitable pressures. In this invention, the metal powder has a particle size (average diameter) of between about 1 and 20 microns, with 5 microns being optimal.

Reinforcing ceramic particulate is employed in the composite to improve its strength and durability. For this purpose a mixture of at least two of: barium titanate ($BaTiO_3$), titanium dioxide ($TiO_2$), and titanium nitride (TiN) are included as a powder having an average particle size of between about 0.1 microns and 100 microns, more preferably being between about 0.1 and 1 micron. The particle size of the metal powder as well as the ceramic particulate powder is necessary to ensure a substantially uniform distribution in the final metal-matrix composite. Otherwise, the ceramic component would form localized islands which could contribute to less than desirable physical properties of the MMC. Other reinforcing ceramic particulate materials which are particularly effective to further enhance the physical properties of the composite are metal carbides like titanium carbide or other titanates like calcium titanate. For example, inclusion of the carbide has been found to improve the mechanical and thermal properties of the light-weight metal-matrix composites.

The total reinforcing particulate, including e.g., the oxides such as barium titanate, nitrides such as titanium nitride and carbides disclosed above, is present in the composite in an amount up to about 70 percent by volume of the total composite. In using aluminum metal, e.g., the ceramic particulate preferably comprises 10 to 30 volume percent of the total composite. The barium titanate and the titanium oxide, when present together in a composite, are preferably present in a volume ratio of between about 5% to 75%, more preferably in a volume ratio of about 5 to 30% of the MMC. The ratio may vary based on the intended application. For example, one can use lower volume fractions of ceramic (e.g., 5–30%) for structural applications or higher volume fractions (45 to 75%) for specialized applications such as electronic packaging. Preferably, the particulate used in the composite includes barium titanate, titanium dioxide, metal carbides and metal nitrides. This combination of ceramic reinforcing materials desirably allows for varying the properties in the reinforcing ceramic phase to develop optimal physical properties for the intended application as would be apparent to one skilled in the art in view of the present disclosure.

One source of such ceramic particulates are those derived from the pyrolytic decomposition of paint waste processed under inert conditions as disclosed in U.S. patent application Ser. No. 08/508,875 filed Jul. 28, 1995 and titled "pyrolytic Conversion of Paint Sludge to Useful Materials" which is commonly assigned with this invention. Its disclosure is hereby expressly incorporated by reference for its teachings relative to converting paint sludge. As disclosed in that application, paint sludge as available from automotive plants can be pyrolyzed under particular conditions to provide ceramic materials. These paint decomposition materials are desirably a low cost source of the ceramic reinforcing particulate useful in the present invention composite.

We have found that the use of the disclosed invention oxides, nitrides, and carbides as reinforcing particulate provide a strong, and durable composite and when used with lightweight metals like aluminum provides very desirable lightweight composites. In addition, use of these particulates in composites made of aluminum allows for easier reclamation of pure aluminum back from the composite. That is, the barium titanate which is preferably included in the composite is more dense than the aluminum and readily removed from reclaimed aluminum. In contrast, the SiC, TiN, and $Al_2O_3$ reinforcing particulate conventionally used in aluminum composites are of about the same density as the aluminum and hence it is more difficult to separate these reinforcing materials from the aluminum during reclamation.

To make the invention composite, powder metallurgy techniques are employed whereby, as discussed above, a powder of the metal is mixed with the reinforcing ceramic particulate and subjected to high pressures to form a green body component. Such techniques are well know to those skilled in the art, and optimal parameters of this process as employed to make the present invention composite will be apparent to those skilled in the art in view of the present disclosure. The pressing technique for forming the green body would be optimally by uniaxial or isostatic according to this invention. In the present invention, a binder would not be required, and is not desirably included in the green body formation. The green body is then subjected to an elevated temperature, optimally as high as 1000° C. for aluminum composites, to densify the component. The firing temperature for the MMC would depend in part on the metal used and selection of such temperature would be within the skill of one in the art in view of the present disclosure.

EXAMPLES

Two embodiment (I and II) of the present invention MMC were fabricated from the mixture of ceramic particles as described in detail in the following paragraphs.

Figure 2:
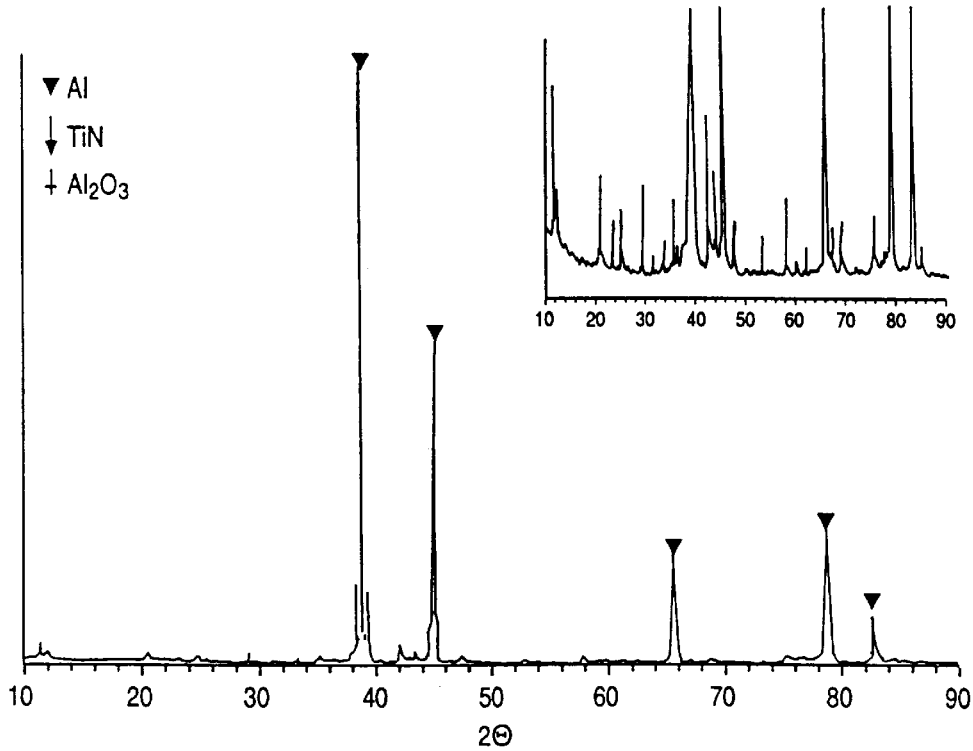
FIG. 2 is an X-Ray Powder Diffraction of the metal matrix composite of FIG. 1 showing the presence of Al, TiN and $Al_2O_3$.

I Particulate mixture of $TiO_2$ and TiN $TiO_2$ rutile was prepared by hydrolysis of titanium isopropoxide and subsequent heating to 900° C. in a nitrogen atmosphere to obtain the rutile form. The $TiO_2$ was identified by XRD. TiN was obtained from Aldrich Chemical Company. The metal fraction of the composite is aluminum powder of 99% purity and having <5 $\mu$m average diameter, obtained from Cerac Advanced Specialty Inorganics. A mixture of 50:50 by weight of $TiO_2$ (rutile) and TiN was formed and ground overnight in a turbula mill with the aluminum powder to form a mixture comprising ~10 volume percent ceramic particulate based on the total weight, the balance being aluminum. A green body of the MMC was prepared by uniaxial pressing (10 tons per sq. inch). The resultant green body was fired in a quartz tube to 500° C. under helium at a rate of 5° C./min with a 4 hour hold time in a dynamic helium atmosphere. The XRD spectra (FIG. 1) of the MMC fired to 500° C. consisted of Al, TiN, and small amounts of AlN. Subsequent firing to 1000° C. produced a final metal-matrix composite with a density of 2.75 g/ml and an XRD spectrum (FIG. 2) indicating Al, $Al_2O_3$ and TiN. Scanning Electron Microscopy of the final composite fired at 1000° C. shows a continuous aluminum phase with substantially uniformly interspersed ceramic particles which resulted in a composite which displayed excellent physical properties. This is believed due to the such features as the particular ceramic particulate, their particle size, and the size of the aluminum powder particle size used in forming the MMC herein.

II. Ceramic particulate from the pyrolysis of paint waste.

Figure 3:
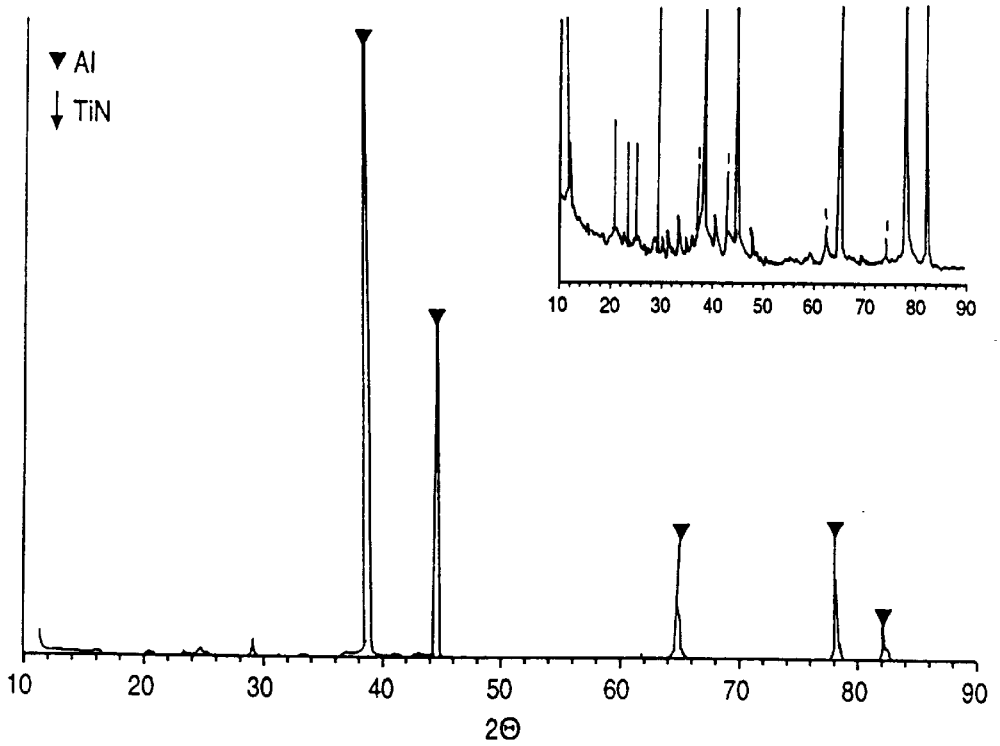
FIG. 3 is an X-Ray Powder Diffraction of a metal matrix composite according to an embodiment of the present invention including reinforcing ceramic particulate derived from pyrolyzed paint waste and shows the presence of Al, and TiN.
Figure 4:
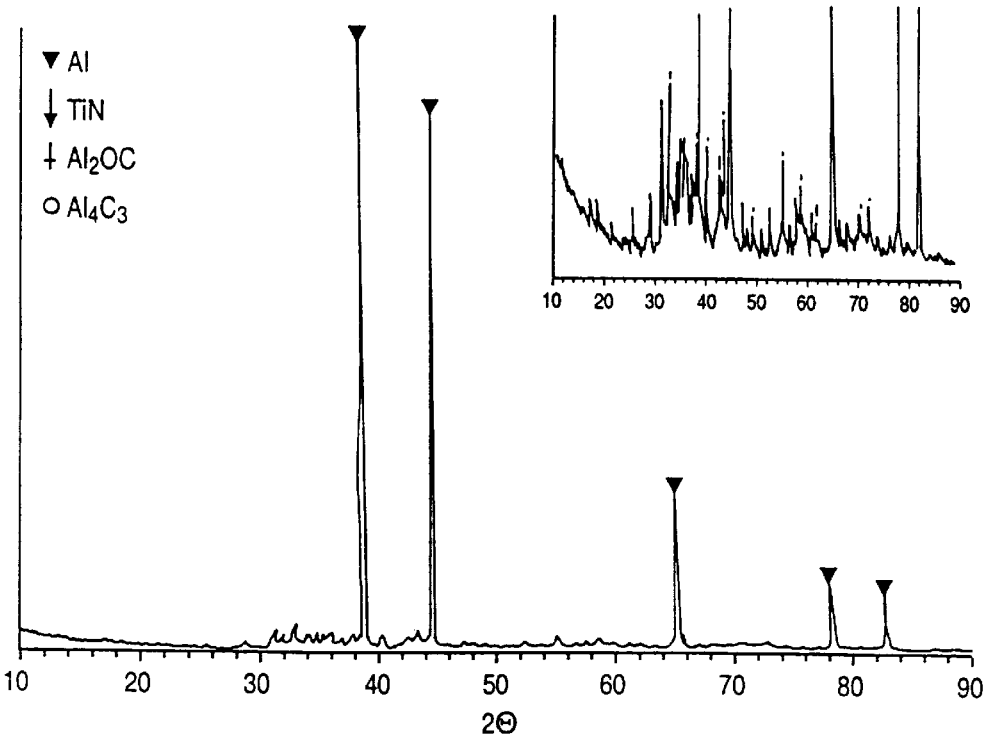
FIG. 4 is an X-Ray Powder Diffraction of the metal matrix composite of FIG. 3 and shows the presence of Al, TiN, $Al_2OC$ and $Al_4C_3$.

The ceramic powder for this example was derived from the pyrolysis of paint waste under an ammonia atmosphere at 1000° C. The average particle size of the ceramic mixture was determined to be 0.4 microns by SEM. The XRD spectrum shows diffraction peaks due to TiN, $BaTiO_3$ and $CaTiO_3$. The elemental analysis of the ceramic powder shows C 7.89%, H<0.5%, N 12.4%, Ti 24.05%, Ba 8.89% and Al 3.09%. The powder contained calcium titanate:barium titanate:titanium nitride in about a 2:3:10 wt. ratio as estimated from XRD peak heights. The mixture was prepared as in the example I above and formed into a green body with aluminum, which contained about 10 volume percent ceramic particulate. The green body was fired in a quartz tube to 500° C. under helium at a rate of 5° C./min with a 4 hour hold time in a dynamic helium atmosphere. The XRD spectra (FIG. 3) consisted mainly of Al and TiN. Subsequent firing to 1000° C. produced a MMC with a density of 2.36 g/ml. XRD (FIG. 4) shows the predominant component to be Al with TiN and $Al_2OC$ and small peaks of $Al_4C_3$. Scanning Electron Microscopy of the 1000° C. fired composite shows that the aluminum has substantially formed a continuous phase as is necessary for desirable physical properties. The reinforcing particles are well distributed uniformly throughout the aluminum matrix due it is believed to the use of the particular ceramic particulate and the aluminum powder size which is believed to enhance preparation of the MMC which was strong and durable.

We claim:

1. A strong, durable metal-matrix composite made by powder metallurgy techniques and comprising:

(a) a substantially continuous phase of metal; and (b) reinforcing ceramic particulate substantially uniformly dispersed therein, said particulate being derived from pyrolysis of paint sludge and comprising at least two of barium titanate, titanium dioxide and, titanium nitride, wherein the ceramic particulate has an average particle diameter of between 0.1 microns and 100 microns and comprises from 5 up to about 70 volume percent of said composite.

2. The metal-matrix composite according to claim 1 which further comprises metal carbides reinforcing particulate.

3. The metal-matrix composite according to claim 2 wherein said metal carbide is titanium carbide.

4. The metal-matrix composite according to claim 1 which further comprises calcium titanate.

5. The metal-matrix composite according to claim 1 wherein said metal is selected from the group consisting of aluminum, titanium, magnesium, copper, and nickel.

6. The metal-matrix composite according to claim 5 wherein said metal is aluminum and said reinforcing ceramic particulate comprise about 10 to 30 volume percent of said composite.

7. The metal-matrix composite according to claim 1 wherein in forming said composite by powder metallurgy techniques the metal is provided in the form of a metal powder having an average diameter of between about 1 and 20 microns.

8. The metal-matrix composite according to claim 7 wherein said metal powder has an average diameter of about 5 microns.

9. A strong, lightweight, and durable metal-matrix composite made by powder metallurgy techniques and comprising:

(a) a substantially continuous phase of lightweight metal selected from the group consisting of aluminum, titanium and magnesium; and (b) reinforcing ceramic particulate substantially uniformly dispersed therein and comprising barium titanate and titanium nitride, wherein the ceramic particulate is derived from the pyrolysis of paint sludge and has an average particle diameter of between about 0.1 micron and 1 micron and comprises from 5 up to about 70 volume percent of said composite.

10. The metal-matrix composite according to claim 9 which further comprises calcium titanate reinforcing particulate.

11. The metal-matrix composite according to claim 9 which further comprises metal carbides reinforcing particulate.

12. The metal-matrix composite according to claim 11 wherein said metal carbide is titanium carbide.

13. The metal-matrix composite according to claim 9 wherein said metal is aluminum and said reinforcing ceramic particulate comprise about 10 to 30 volume percent of said composite.

14. The metal-matrix composite according to claim 9 wherein in forming said composite by powder metallurgy techniques the metal is provided in the form of a metal powder having an average diameter of between about 1 and 20 microns.

15. The metal-matrix composite according to claim 14 wherein said metal powder has an average diameter of about 5 microns.

16. A process for forming a strong, durable metal matrix composite by powder metallurgy techniques which comprises the steps of:

mixing (1) a metal powder having an average particle diameter of between about 1 and 20 microns; and (2) reinforcing ceramic particulate to form a substantially uniformly dispersed Mixture, said reinforcing ceramic particulate being derived from the pyrolysis of paint sludge and comprising at least two of barium titanate, titanium dioxide, and titanium nitride, and wherein the ceramic particulate has an average particle diameter of between 0.1 microns and 100 microns and comprises from 5 up to about 70 volume percent of said mixture;

subjecting said mixture to sufficient pressure to form a green body thereof; and firing said green body at a temperature sufficient to form a metal-matrix composite thereof.

17. The method according to claim 16 wherein said method further comprises providing metal carbides reinforcing particulate in said powder mixture.

18. The method according to claim 17 wherein said metal carbide is titanium carbide.

19. The metal-matrix composite according to claim 18 wherein said method further comprises providing calcium titanate reinforcing particulate in said powder mixture.

20. The method according to claim 16 wherein said metal is aluminum and said temperature for firing said green body is up to about 1000° C.

* * * * *